US010327535B2

(12) United States Patent
Steele

(10) Patent No.: US 10,327,535 B2
(45) Date of Patent: Jun. 25, 2019

(54) HIKING SURVIVAL PACK

(71) Applicant: Stuart Steele, West Milford, NJ (US)

(72) Inventor: Stuart Steele, West Milford, NJ (US)

( * ) Notice: Subject to any disclaimer, the term of this patent is extended or adjusted under 35 U.S.C. 154(b) by 35 days.

(21) Appl. No.: 15/363,079

(22) Filed: Nov. 29, 2016

(65) Prior Publication Data

US 2017/0156478 A1 Jun. 8, 2017

Related U.S. Application Data

(60) Provisional application No. 62/386,488, filed on Dec. 2, 2015.

(51) Int. Cl.

| | |
|---|---|
| ***A45F 3/04*** | (2006.01) |
| ***A45F 3/20*** | (2006.01) |
| ***A45F 3/00*** | (2006.01) |
| ***A45F 3/14*** | (2006.01) |
| ***A45F 3/16*** | (2006.01) |

(52) U.S. Cl.

CPC ..... *A45F 3/00* (2013.01); *A45F 3/14* (2013.01); *A45F 3/16* (2013.01); *A45F 2003/045* (2013.01); *A45F 2003/148* (2013.01); *A45F 2003/166* (2013.01)

(58) Field of Classification Search

CPC ..... A45F 3/20; A45F 2003/045; A45F 3/047; A45F 3/04; A45F 3/14; A45F 2003/144; A45F 3/16; A45F 2003/166; A45F 2003/148; A45F 3/00

USPC ..... 224/259, 645–647, 148.2, 148.4

See application file for complete search history.

(56) References Cited

U.S. PATENT DOCUMENTS

| | | | | |
|---|---|---|---|---|
| 4,634,031 | A | 1/1987 | Frankhouse | |
| 4,700,761 | A * | 10/1987 | Gladding | A45C 3/00 150/109 |
| 8,225,973 | B1 | 7/2012 | Bellinson | |
| 2007/0152007 | A1 | 7/2007 | Kauss et al. | |
| 2008/0217367 | A1 | 9/2008 | Lillie | |
| 2014/0191002 | A1 | 7/2014 | Garcia Morales | |
| 2014/0346209 | A1* | 11/2014 | Amend | A63C 11/025 224/600 |

(Continued)

FOREIGN PATENT DOCUMENTS

| | | |
|---|---|---|
| CN | 204245384 U | 4/2015 |
| CN | 204427030 U | 7/2015 |

OTHER PUBLICATIONS

Kings Camo Daylite Hydration Waist Pack; http://www.sierratradingpost.com/kings-daylite-hydration-waist-pack~p~125nj/ accessed Jul. 12, 2016.

(Continued)

*Primary Examiner* — Adam J Waggenspack

(74) *Attorney, Agent, or Firm* — Myers Wolin, LLC

(57) ABSTRACT

A hiking survival pack system that may be used for hiking, trail-running, backpacking, biking, hunting, fishing, or other indoor or outdoor activities is disclosed. The hiking survival pack has two chambers that are worn over the user's shoulders and secured to the user with a plurality of attachments. Each chamber has an access that allows the user to store and remove items. On the back of the hiking survival pack, there is a storage sack that may hold a fluid container. The fluid container has an opening that allows for a tube to be connected to it. The user may drink the contents of the fluid container via the tube.

19 Claims, 3 Drawing Sheets

(56) References Cited

U.S. PATENT DOCUMENTS

2015/0366332 A1* 12/2015 Marji ..... A45F 3/04
224/583
2016/0128394 A1* 5/2016 Kohrman ..... A45F 3/14
2/102

OTHER PUBLICATIONS

NRS PFD Hydration Pack | CKS; http://www.coloradokayak.com/NRSPFDHydrationPack; Accessed Jul. 12, 2016.
Platatac Echo Hydration Pack MKII + Straps; http://www.platatac.com/platatacechohydrationpackmkiistraps.html; Accessed Jul. 12, 2016.
Zippered Yoga Mat Carrier Mat Bag; https://www.matsmatsmats.com/yoga/yogazippertote.html; Accessed Jul. 12, 2016.

* cited by examiner

HIKING SURVIVAL PACK

CROSS REFERENCE TO RELATED APPLICATIONS

This application claims the benefit of U.S. Provisional Application No. 62/386,488, filed Dec. 2, 2015, the contents of which are hereby incorporated by reference in their entirety.

FIELD OF THE INVENTION

The present invention relates generally to wearable hiking survival packs. More specifically, the invention relates to methods and systems for providing wearable hiking survival packs for carrying items for hiking, survival and related activities.

BACKGROUND

Hiking requires long, vigorous walks, usually on trails, footpaths, hills, mountains and valleys. This walking of long distances requires a lot of sustained energy. Consequently, hikers typically try to improve their efficiency by implementing techniques to travel faster and farther, conserve energy and reduce fatigue. Hikers use techniques that result in a reduction and elimination of resistance to motion, an increase in stride to increase speed and endurance, an improvement in breathing for increased speed and alertness, and a reduction and elimination of energy wasting motion. Hikers further improve their performance by reducing and eliminating resistance to efficient fluid motion in their clothing, footwear, packs and gear that resist efficient fluid motion or generate discomfort.

Weight reduction is another method hikers use to increase their performance. To carry their affairs, hikers have typically used backpacks. Historically, the backpack is a storage container located on the back of an individual supported by shoulder straps. Items can be attached to shoulder straps, however the shoulder straps do not provide storage for items within. The nonuse of the straps is a waste of valuable space that a hiker could use to store their belongings.

Water is typically the heaviest item hikers have to carry. Hikers often use hydration packs to carry water. A hydration pack is a fluid-carrying device used to carry water, a sports drink, coffee, or another consumable fluid during walking, backpacking, bicycling, hiking, trail-running, jogging, or other athletic activities. A hydration pack typically includes a bladder or other fluid reservoir that is attached to the associated person by straps or other fasteners. A fluid delivery tube extends from the fluid reservoir, such as a fluid bladder, fluid container, or so forth, and at the distal end includes a bite valve or other mechanism to selectively allow the person to drink. In some hydration packs, the bite valve or other delivery mechanism is readily accessed while performing rigorous activity. A typical hydration pack employs an elongated fluid reservoir that is invertedly positioned in a backpack substantially centered, on the spine of the back, with the fluid delivery tube connected at the bottom of the fluid reservoir. Such an arrangement promotes efficient and complete delivery of all fluid in the backpack, and also keeps weight centered on the spinal column. However, existing hydration packs are problematic in that they have a tendency to shift about during rigorous activity, which can tend to unbalance the wearer or in extreme cases cause a fall or other accident. In such a fall or accident, there is potential for serious injury, including in some cases injury to the kidneys, liver, or other vital organs. In addition, many hydration packs do not allow for the efficient storage of other items that a hiker may wish to carry. Furthermore, because many hydration packs are permanently fixed to or stored within a backpack, refilling the hydration sack is very difficult.

Therefore, there is a need for a more efficient, lighter, and wearable hiking survival pack for carrying fluid and items for hiking and trail-running.

SUMMARY

Certain embodiments of the invention include a hiking survival pack comprising a plurality of storage chambers. Each storage chamber may further comprise a first end, a second end, and an interior defined between the first and second ends. Each storage chamber may further comprise a front including an access extending between the first end and the second end for access to the interior, wherein the front of each storage chamber may further comprise a first side on one side of the access and a second side on the other side of the access. A releasable attachment may be disposed adjacent to the first end of each storage chamber and extend between the first side of each storage chamber for attaching the plurality of storage chambers adjacent to the first end of each storage chamber. Each storage chamber may further comprise a variable-length tensioner attached to the second side at a position adjacent to the first end and a position adjacent to the second end for adjusting the position of the first end relative to the second end and thereby the position of the hiking survival pack relative to a user.

In some exemplary embodiments, the variable-length tensioner extends outwardly from each storage chamber.

In certain exemplary embodiments, the access is a zipper closure.

In several exemplary embodiments, the interior is uninterrupted and continuous from the first end to the second end.

In one exemplary embodiment, at least one storage chamber further comprises at least one webbing strap attached to the front.

In certain exemplary embodiments, each storage chamber is further configured such that a centerline distance defined along a back side of the storage chamber from the first end to the second end is shorter than a centerline distance defined along the front of the storage chamber from the first end to the second end, thereby presenting storage chambers that are curved when viewed from the side.

In one exemplary embodiment, the storage chambers are curved due to one or more filler pieces.

In another exemplary embodiment, the storage chambers are curved due to a cutting out of a portion of the back side of the storage chambers.

In several exemplary embodiments, the hiking survival pack comprises a hydration sack.

In one exemplary embodiment, the hydration sack is located between the plurality of storage chambers.

In another exemplary embodiment, the hydration sack is attached to the first side of each storage chamber adjacent to the second end.

In yet another exemplary embodiment, the hydration sack comprises an opening.

In another exemplary embodiment, the hydration sack has a lace to seal the opening.

In yet another exemplary embodiment, the hydration sack holds a fluid container.

In another exemplary embodiment, the fluid container is attached to a tube.

In yet another exemplary embodiment, the tube is secured to the hiking survival pack with a securing mechanism.

In another embodiment, the fluid tube comprises an internal fluid tube.

In additional embodiments, the hydration sack is a fluid bladder.

In additional embodiments, each storage chamber is reinforced with support stitching at approximately the midsection of the storage chamber.

In additional embodiments, each storage chamber comprises a separator to compartmentalize different sections of the interior.

DETAILED DESCRIPTION OF THE PREFERRED EMBODIMENTS

Figure 1:
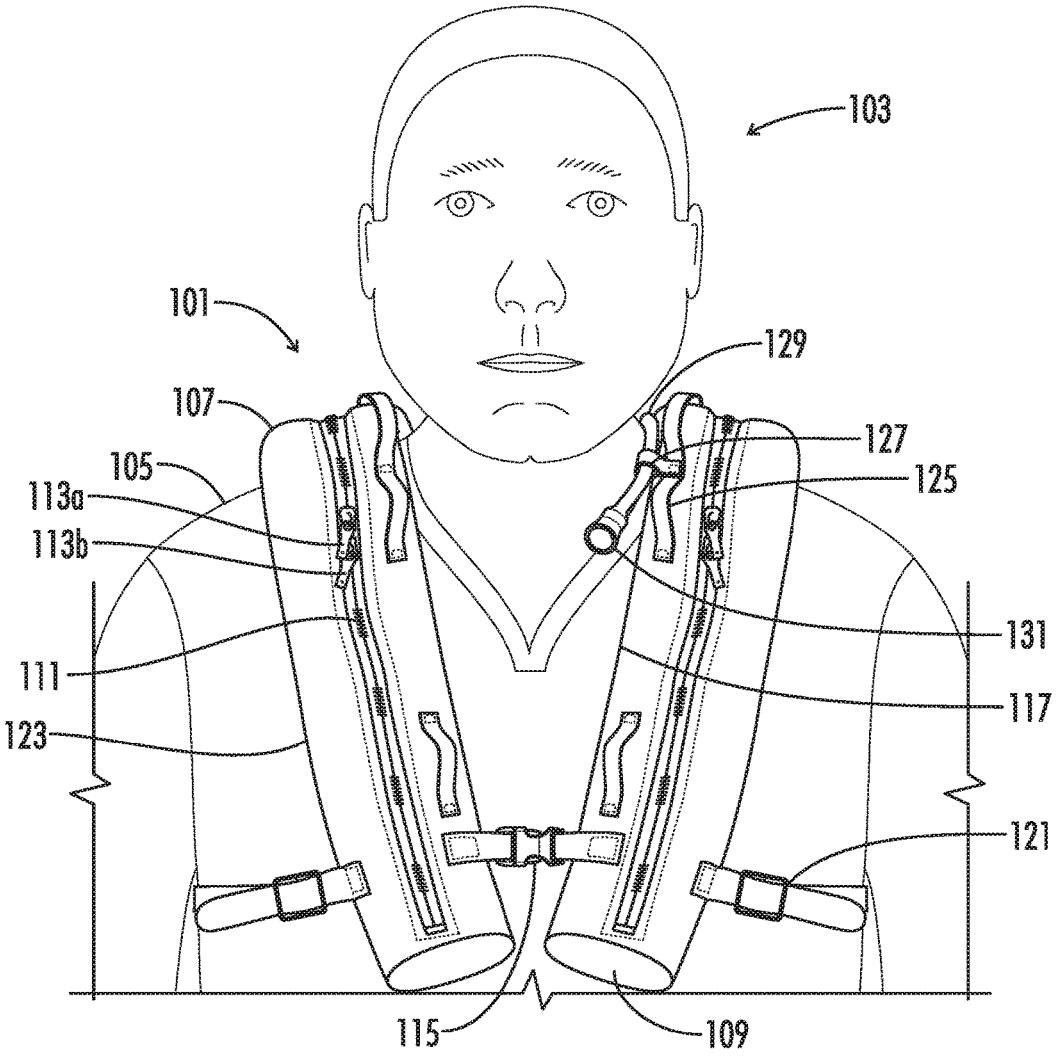
FIG. 1 is a front view of one embodiment of a hiking survival pack of the present disclosure.

The description of illustrative embodiments according to principles of the present invention is intended to be read in connection with the accompanying drawings, which are to be considered part of the entire written description. In the description of embodiments of the invention disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached," "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits of the invention are illustrated by reference to the exemplified embodiments. Accordingly, the invention expressly should not be limited to such exemplary embodiments illustrating some possible non-limiting combination of features that may exist alone or in other combinations of features; the scope of the invention being defined by the claims appended hereto.

This disclosure describes the best mode or modes of practicing the invention as presently contemplated. This description is not intended to be understood in a limiting sense, but provides an example of the invention presented solely for illustrative purposes by reference to the accompanying drawings to advise one of ordinary skill in the art of the advantages and construction of the invention. In the various views of the drawings, like reference characters designate like or similar parts.

Turning now to FIG. 1, one embodiment of a front view of the hiking survival pack 101 is shown as worn by a user 103. The hiking survival pack 101 is typically worn over the user's shoulders 105 as shown in FIG. 1, although it could be worn or carried by a user in other configurations. The hiking survival pack 101 of the embodiment of FIG. 1 comprises two or more storage chambers 107, each storage chamber 107 further comprising an end 109 at each terminus of the storage chamber 107 and an interior between the termini. Each storage chamber 107 may be any shape or size to accommodate different capacities and needs of the user. The end 109 is useful in that it supports much of the weight of the items placed in the storage chamber 107. Each storage chamber 107 may further comprise a separator (not shown) to compartmentalize different sections of the interior or may be uninterrupted and continuous from one terminus to the other. Each storage chamber 107 has an access 111 to allow the user 103 to open and close the storage chamber 107 to store and remove items. The access 111 may comprise one or more opening and closing structures, including one or more zipper closures with one or more zipper pulls 113*a,b*, mechanical fasteners, magnetic fasteners, hook and loop fasteners, ties, straps, stitched structures, taped structures, glued structures, caps, clips, buttons, and snap-in structures. Other access and opening/closing structures are contemplated. In the illustrated embodiment, a releasable attachment 115 is attached to a first side 117 of each storage chamber 107 at a position adjacent to the end 109 of the storage chamber 107. The releasable attachment 115 may comprise one or more structures, including a zipper closure, mechanical fastener, magnetic fastener, hook and loop fastener, tie, strap, stitched structure, taped structure, glued structure, cap, clip, button, or snap-in structure, or the like. A variable-length tensioner 121 is attached to a second side 123 of each storage chamber 107 and allows a user to vary not only the amount of curvature and therefore fit of each storage chamber 107 relative to a user while worn or carried, but also the overall diameter of the hiking survival pack, i.e. from the front of the pack to the rear of pack, to accommodate different body types as well as different storage (as discussed below) of varying sizes and diameters between the chambers 107, particularly as would be present along the rear of the pack. The variable-length tensioner 121 may comprise one or more structures, including a zipper closure, mechanical fastener, magnetic fastener, hook and loop fastener, tie, strap, taped structure, glued structure, cap, clip, button, or snap-in structure. Each storage chamber 107 may comprise one or more straps 125. The straps 125 may be secured to the storage chamber 107 using one or more structures, including a zipper closure, mechanical fastener, magnetic fastener, hook and loop fastener, tie, strap, stitched structure, taped structure, glued structure, cap, clip, button, or snap-in structure. The straps 125 may comprise one or more webbing straps 127 to hold or hang the hiking survival pack 101, for example, on a tree limb or a hook or to hold or support another part of the hiking survival pack 101. The webbing straps 127 may be arranged in loop. The webbing strap 127 may also be used to secure gear, including a head cap, balaclava, gloves, compass, flashlight, headlamp, food, matches, knife, sunscreen, sunglasses, whistle, insect repellent, socks, shirts, pants, clothing, keys, toilet paper, bags, hiking poles, GPS, radio, ID, field guides, and binoculars. A fluid tube 129 comprising a dispensing mechanism 131 is attached to the storage chamber 107. The fluid tube 129 may be secured to the storage chamber 107 by one or more straps 125, webbing straps 127, U-shaped flex plastic, or other tie-down methods. The dispensing mechanism 131 may comprise one or more of a valve, bite valve, cap, lid, or screw.

Figure 2:
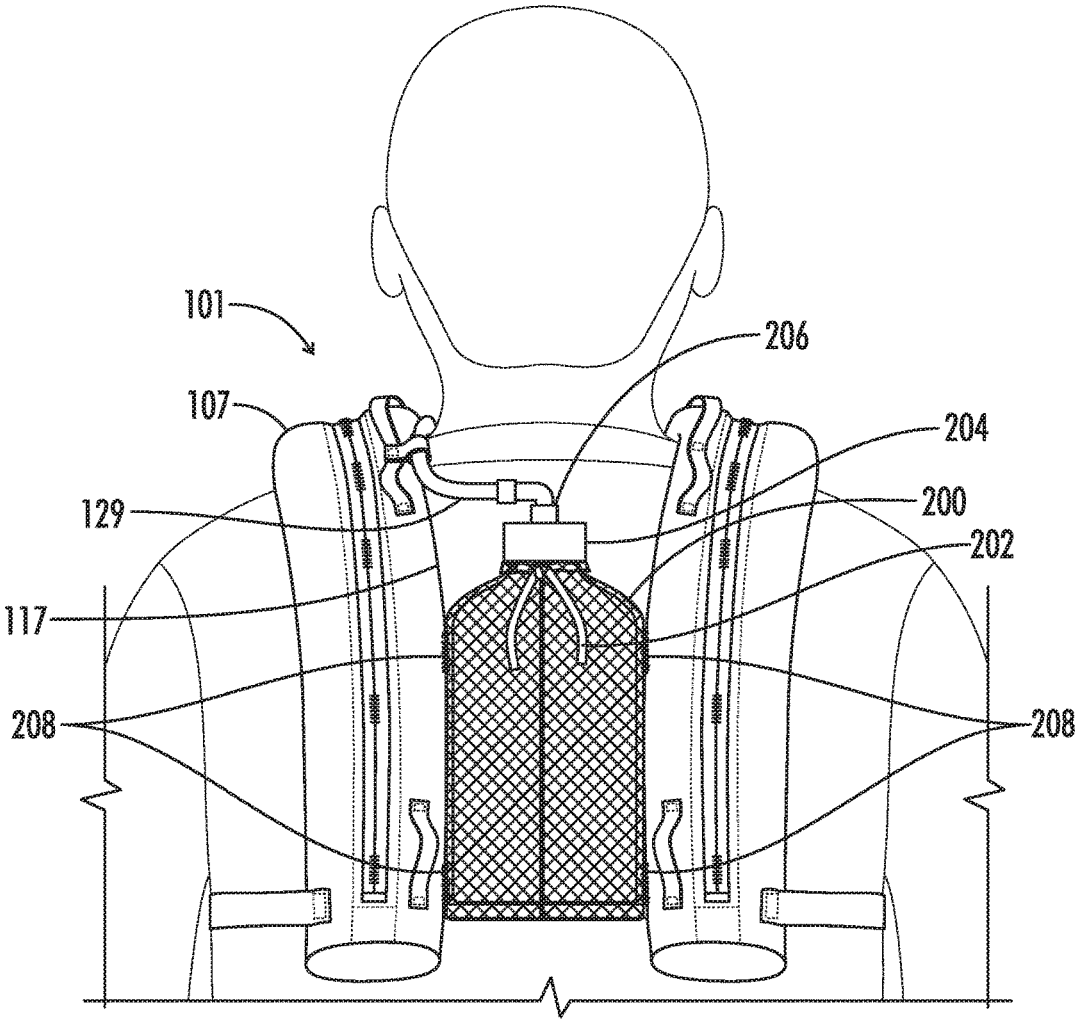
FIG. 2 is a rear view of one embodiment of the hiking survival pack of the present disclosure.

Turning now to FIG. 2, one embodiment of a rear view of the hiking survival pack 101 is shown. This particular embodiment illustrates a storage sack 200 located between the two storage chambers 107 and attached at each chamber's first side 117 at one or more locations. While a storage sack 200 is shown, it will be appreciated that in certain embodiments the hiking survival pack of the present disclosure may be operable without the storage sack 200 or without a separate storage component disposed between the chambers 107. In the event the hiking survival pack of the present disclosure is used without the incorporation of a storage sack, then, for example, the one or more straps 125, webbing straps 127 or the like may be repurposed to secure other items to be carried by the pack. In addition, in the illustrated embodiment, while the storage sack 200 is illustrated in one orientation relative to the chambers 107, it will be appreciated that other implementations are possible within the scope of the present disclosure.

Returning now to the embodiment of FIG. 2, storage sack 200 may be either permanently attached or adjustably attached to the two storage chambers 107. Storage sack 200 may be attached to the storage chambers 107 at one or more securing positions 208 with at least one welding, sewing, zipper closure, mechanical fastener, magnetic fastener, hook and loop fastener, tie, strap, stitched structure, taped structure, glue, adhesive, clip, button, or snap-in structure. Other methods of attachment, placement and orientation are contemplated. The storage sack 200 may be secured to the storage chambers 107 along all or the majority of its length on one or both sides. The storage sack 200 may comprise one or more of a mesh, fishnet, solid or porous sack, bag, or container. Other material compositions are contemplated. The storage sack 200 may comprise a fluid bladder or bag that holds any fluid, including water, low pH water (acidic water), high pH water (alkaline water), ionized water, flavored water, electrolyte-fortified water, vitamin-fortified water, mineral-fortified water, milk, soda, juice, sport drinks, tea, coffee, or any other drink. The storage sack 200 may also be configured to accommodate any type of vessel for storing a consumable such as a drink or the like. The storage sack 200 is opened and closed with at least one sealing mechanism 202. The sealing mechanism 202 may comprise one or more of a lace that is tied and untied, a cord, zipper closure, mechanical fastener, magnetic fastener, hook and loop fastener, tie, strap, stitched structure, taped structure, glued structure, cap, clip, button, or snap-in structure. The sealing mechanism 202 may be secured with a cord lock, although other sealing structures are contemplated.

The storage sack 200 may hold a fluid container 204 with an opening 206 for the fluid tube 129. The fluid tube 129 may comprise an internal tube within the fluid container 204, positioned at or near the bottom of the fluid container 204, for transporting the fluid at the bottom of the fluid container 204. The fluid container 204, which may be a sack, bag, bottle, bladder, canteen or flask and may store water, low pH water (acidic water), high pH water (alkaline water), ionized water, flavored water, electrolyte-fortified water, vitamin-fortified water, mineral-fortified water, milk, soda, juice, sport drinks, tea, coffee, or any other drink or consumable. The bottom of the storage sack 200 may comprise a reinforced hole to hold the fluid container 204 and to help drain any fluid that may accumulate in the storage sack 200, and may be sized to accommodate, receive and secure the neck and cap of any sized container including what might be considered to be a standard water bottle for example. Other constructions are possible. In one embodiment of the invention, the fluid container 204 may be placed in an inverted position in the storage sack 200. In another embodiment of the invention, the fluid container may comprise a bottle cap. In yet another embodiment of the invention, the bottle cap may be attached to a 90° adapter. Other embodiments are contemplated. The storage sack 200 may hold other items, including a head cap, balaclava, gloves, compass, flashlight, headlamp, food, matches, knife, sunscreen, sunglasses, whistle, insect repellent, socks, shirts, pants, clothing, keys, toilet paper, bags, hiking poles, GPS, radio, ID, field guides, binoculars, or any other hiking or survival gear.

Figure 3:
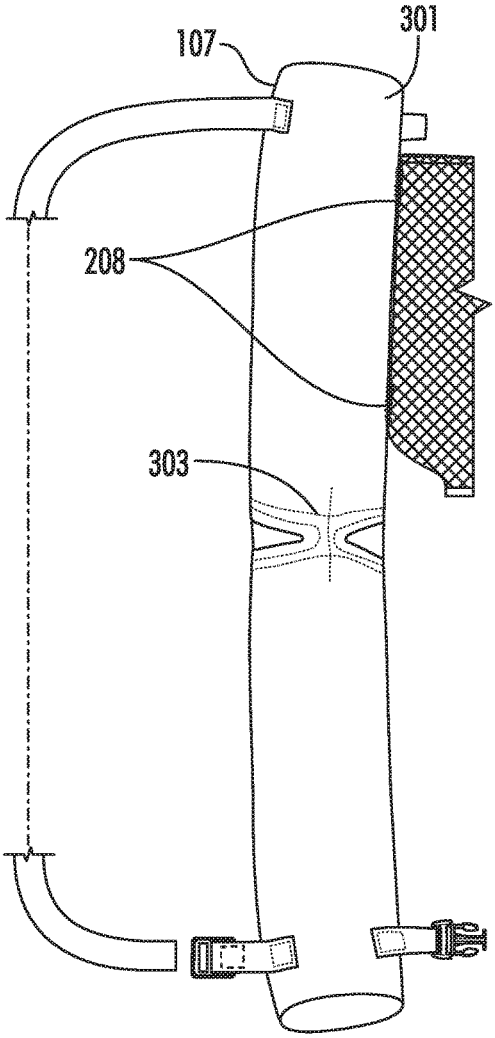
FIG. 3 is a rear view.

Turning now to FIG. 3, one embodiment of a back-side view 301 of the storage chamber 107 is shown. The hiking survival pack 101 is worn such that approximately the midsection of the storage chamber 107 rests on the user's shoulder. The storage chamber 107 may be filled with any item a user 103 wishes to store in it, such as hiking gear, camping gear, survival gear, fishing equipment, tools, ammunition, and clothing. Much of the stress of the weight of the stored items is thus placed on approximately the midsection of the storage chamber 107. Without proper support, the storage chamber 107 may be torn or ripped while in use. To avoid this damage, the midsection of the chamber is fortified with support stitching 303. Thus when stress is applied, the midsection is better equipped to handle the forces and redistribute the stress to other parts of the hiking survival pack 101. The support stitching may be stitched by hand, a sewing machine or a combination of both, and while the support stitching 303 is illustrated around the mid-section of the chamber, it will be appreciated that other locations are contemplated and/or that more than one location may be contemplated if desired.

Figure 4:
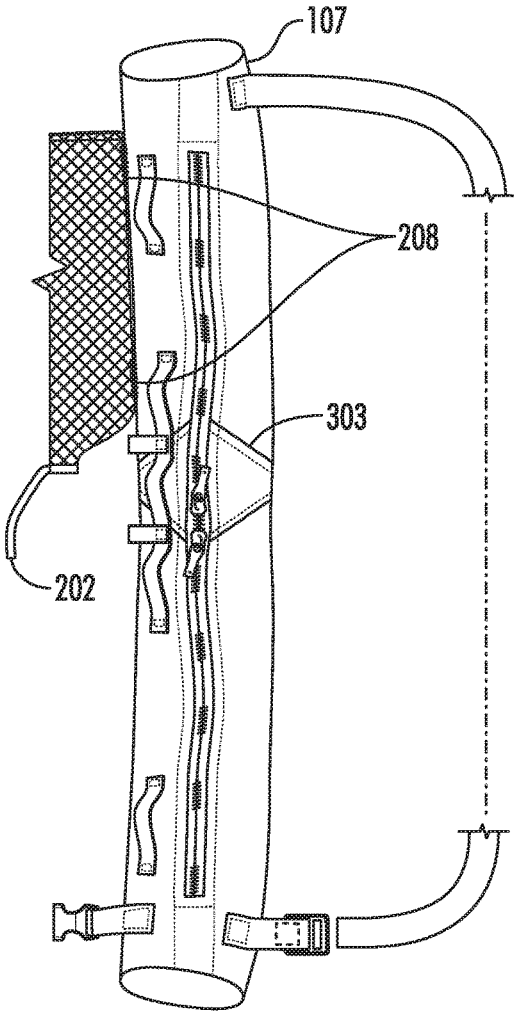
FIG. 4 is a front view of one embodiment of a chamber of the hiking survival pack of the present disclosure.

Turning now to FIG. 4, a front view of the storage chamber 107 is shown. The support stitching 303 may also be located on the front of the storage chamber 107 to fortify the approximate midsection of the storage chamber 107. Support stitching 303 may be used on any section of the hiking survival pack 101 for fortification, stylistic or design purposes. Support stitching 303 may lengthen the storage chamber 107 to provide curvature by means of one or more filler pieces or patches on the top side of the storage chamber 107. The bottom side of the storage chamber 107, the side resting on the user's 103 shoulder 105, may be cut back and/or sliced in an inverted "V" shape and reinforced internally from the bottom to the access 111. The filler pieces may be butterfly-shaped or other-shaped as desired. One embodiment of a sealing mechanism 202 for sealing the storage sack 200 is a lace that hangs freely when not tied. The lace may be tied to close the opening of the storage sack 200.

The hiking survival pack 101 provides the user 103 many advantages during use and operation. Use of the hiking survival pack 101 may begin by pulling one zipper handle 113*a* in a direction that is distal to the other zipper handle 113*b* in order to open the access 111. The interior of the chamber 107 may then be loaded with the appropriate items. The zipper handle 113*a* may then be pulled toward the other zipper handle 113*b* in order to close the access. The fluid container 204 may then be inserted into the storage sack 200. Then the storage sack 200 may be sealed by tying or closing the sealing mechanism 202. If the storage sack 200 is being loaded while on the user 103, the sealing mechanism 202 closest to the end 109 may be sealed before loading the fluid container 204 to prevent the fluid container 204 from falling on the ground. The fluid tube 129 may then be secured by the webbing straps 127. Once properly loaded, the hiking survival pack 101 may then be assembled onto the user 103. Each storage chamber may be placed over one of the user's shoulders 105, such that one end 109 is in front of the user 103 and the other end 109 is behind the user 103. The releasable attachment 115 may then be attached such that each storage chamber 107 is fixed to the other at a position adjacent to the end 109. Next, the variable-length tensioner 121 may be tightened or loosened to assure a comfortable and safe fit of the hiking survival pack 101 on the body. While hiking, trail-running or performing an activity, the dispensing mechanism 131 may be placed in the user's mouth in order to drink the fluid in the fluid container 204 via the fluid tube 129. The above-mentioned steps for usage and assembly do not have to take place in any particular order. In other embodiments of the invention, the hiking survival pack 101 may be assembled on the user 103 before the interior or the storage sack 200 is loaded. Thus, this description of usage is simply one of many ways the hiking survival pack 101 may be utilized.

Front to rear storage with the fluid container 204 centrally located in the rear provides several advantages during use. A significant number of backpacks provide for fluid container storage on both sides of the backpack, which is thrusted forward and backward during activity by an individual, thus wasting energy. Several embodiments of the present invention have the fluid container centrally located in the rear to minimize load thrusting. There is no need to remove the hiking survival pack 101 to access fluid or awkwardly remove and return the fluid container 204 to the hiking survival pack 101 to drink because fluid is carried to the front of the hiking survival pack 101 by the fluid tube 129 with the dispensing mechanism 131. Frontal storage allows for swift access to numerous stored items without requiring removal of the hiking survival pack 101. Frontal storage also permits partial front to rear balanced loading for improved comfort.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A hiking survival pack comprising:

a) a plurality of storage chambers;

b) each storage chamber further comprising a first end, a second end, and an interior defined between the first and second ends;

c) each storage chamber further comprising a front including an access extending between the first end and the second end for access to the interior, wherein the front of each storage chamber further comprises a first side on one side of the access and a second side on the other side of the access;

d) a releasable attachment disposed at the first end of each storage chamber and extending between the first side of each storage chamber for connecting the plurality of storage chambers at the first end of each storage chamber;

e) wherein each storage chamber further comprises a variable-length tensioner attached to the second side at a first position disposed at the first end and a second position disposed at the second end for adjusting the position of the first end relative to the second end and thereby the position of the hiking survival pack relative to a user;

f) wherein each storage chamber is curved such that each storage chamber is U-shaped; and g) wherein each storage chamber is curved due to one or more filler pieces that are attached to each storage chamber.

2. The hiking survival pack of claim 1, wherein the variable-length tensioner extends outwardly from each storage chamber.

3. The hiking survival pack of claim 1, wherein the access is a zipper closure.

4. The hiking survival pack of claim 1, wherein the interior is uninterrupted and continuous from the first end to the second end.

5. The hiking survival pack of claim 1, wherein at least one storage chamber further comprises at least one webbing strap attached to the front.

6. The hiking survival pack of claim 1, wherein each storage chamber is further configured such that a centerline distance defined along a back side of the storage chamber from the first end to the second end is shorter than a centerline distance defined along the front of each storage chamber from the first end to the second end, thereby presenting storage chambers that are curved when viewed from the side.

7. The hiking survival pack of claim 6, wherein the storage chambers are curved due to a cut out of a portion of the storage chambers.

8. The hiking survival pack of claim 1, further comprising a hydration sack.

9. The hiking survival pack of claim 8, wherein the hydration sack is located between the plurality of storage chambers.

10. The hiking survival pack of claim 8, wherein the hydration sack is attached to the first side of each storage chamber disposed at the second end.

11. The hiking survival pack of claim 8, wherein the hydration sack comprises an opening.

12. The hiking survival pack of claim 11, wherein the hydration sack has a lace to seal the opening.

13. The hiking survival pack of claim 8, wherein the hydration sack further comprises a fluid container.

14. The hiking survival pack of claim 13, wherein the fluid container is attached to a fluid tube.

15. The hiking survival pack of claim 14, wherein the fluid tube is secured to the hiking survival pack with a securing mechanism.

16. The hiking survival pack of claim 14, wherein the fluid tube comprises an internal fluid tube.

17. The hiking survival pack of claim 8, wherein the hydration sack is a fluid bladder.

18. The hiking survival pack of claim 1, wherein each storage chamber is reinforced with support stitching at the midsection of the storage chamber.

19. The hiking survival pack of claim 1, wherein each storage chamber comprises a separator to compartmentalize different sections of the interior.

* * * * *